US011037740B2

(12) United States Patent
Neau et al.

(10) Patent No.: US 11,037,740 B2
(45) Date of Patent: Jun. 15, 2021

(54) SWITCH LOCKOUT DEVICE

(71) Applicant: Master Lock Company LLC, Oak Creek, WI (US)

(72) Inventors: Michael Neau, Kenosha, WI (US); Andrew Bartel, Franklin, WI (US)

(73) Assignee: Master Lock Company LLC, Oak Creek, WI (US)

( * ) Notice: Subject to any disclaimer, the term of this patent is extended or adjusted under 35 U.S.C. 154(b) by 31 days.

(21) Appl. No.: 16/539,522

(22) Filed: Aug. 13, 2019

(65) Prior Publication Data

US 2021/0050162 A1 Feb. 18, 2021

(51) Int. Cl.
*H01H 9/22* (2006.01)
*H01H 9/02* (2006.01)

(52) U.S. Cl.
CPC ..... *H01H 9/22* (2013.01); *H01H 9/0207* (2013.01)

(58) Field of Classification Search
CPC ..... H01H 9/22; H01H 9/0207; H01H 9/28
USPC ..... 200/43.01–43.22, 50.12
See application file for complete search history.

(56) References Cited

U.S. PATENT DOCUMENTS

| | | | | |
|---|---|---|---|---|
| 5,732,815 | A | 3/1998 | Brouwer | |
| 6,617,532 | B1 | 9/2003 | Turek | |
| D535,629 | S | 1/2007 | Kalous et al. | |
| 7,262,376 | B2 | 8/2007 | Brojanac et al. | |
| D564,859 | S | 3/2008 | Brojanac et al. | |
| 9,208,964 | B2 | 12/2015 | Dudgeon et al. | |
| 2006/0266631 | A1* | 11/2006 | Kalous | H01H 9/283 200/43.14 |
| 2012/0205224 | A1* | 8/2012 | Hackett | H01H 9/283 200/43.14 |

* cited by examiner

*Primary Examiner* — Edwin A. Leon
*Assistant Examiner* — Iman Malakooti
(74) *Attorney, Agent, or Firm* — Calfee, Halter & Griswold LLP

(57) ABSTRACT

A lockout device for a switch assembly includes a body defining a bottom surface and a recess extending inward from the bottom surface to receive a toggle switch, first and second clamping portions disposed on first and second longitudinal sides of the recess, and an adjustable cleat member secured with the body and movable between a retracted position in which the cleat member is retained inward of the bottom surface of the body and an extended position in which the cleat member extends beyond the bottom surface of the body.

20 Claims, 7 Drawing Sheets

SWITCH LOCKOUT DEVICE

BACKGROUND

Many switches, such as, for example, circuit breaker switches, are designed to be manually switched between two positions (for example, an "on" position and an "off" position) by a user. A circuit breaker switch may be configured to reset certain functions of the circuit breaker when the switch is toggled to the "on" position. Switches are commonly located in areas that are publicly or widely accessible. In many situations, accidental, innocent or unauthorized switch position changes can cause safety hazards, damage equipment or cause lost production time and/or in-process material losses.

SUMMARY

The present application describes devices and methods which may be utilized for preventing unauthorized or accidental movement of a switch, for example, between first and second toggle positions. In one embodiment, a lockout device is configured to be used with a switch assembly including a fixed base and a toggle switch moveable between first and second switching positions and disposed between first and second end walls extending to an outer surface of the fixed base.

Accordingly, in an exemplary embodiment, a lockout device for a switch assembly includes a body defining a bottom surface and a recess extending inward from the bottom surface to receive a toggle switch, first and second clamping portions disposed on first and second longitudinal sides of the recess, and an adjustable cleat member secured with the body and movable between a retracted position in which the cleat member is retained inward of the bottom surface of the body and an extended position in which the cleat member extends beyond the bottom surface of the body.

In another exemplary embodiment, a lockout device is provided in combination with a switch assembly including a fixed base and a toggle switch moveable between first and second switching positions and disposed between first and second end walls extending to an outer surface of the fixed base. The lockout device includes a body defining a bottom surface engaging the outer surface of the fixed base of the switch assembly, a recess receiving the toggle switch, a first clamping portion disposed in the recess and in engagement with a first side of the toggle switch, and a second clamping portion disposed in the recess and in engagement with a second side of the toggle switch opposite the first side. The second clamping portion is adjustable between a clamping position for securely clamping the toggle switch between the first and second clamping portions and a releasing position permitting withdrawal of the toggle switch from the recess. A cleat member is secured with the body and movable between a retracted position in which the cleat member is retained inward of the bottom surface of the body and an extended position in which the cleat member extends beyond the bottom surface of the body such that the cleat member is engageable with the second end wall of the switch assembly to prevent movement of the toggle switch to the second switching position.

According to another exemplary embodiment of the present disclosure, a method is contemplated for securing a switch assembly including a fixed base and a toggle switch moveable between first and second switching positions and disposed between first and second end walls extending to an outer surface of the fixed base. In the exemplary method, the toggle switch is placed in the first switching position. A lockout device is provided, including a body defining a bottom surface and a recess extending inward from the bottom surface, first and second clamping portions disposed on first and second longitudinal sides of the recess, and an adjustable cleat member secured with the body. The lockout device is assembled with the switch assembly such that the toggle switch is received in the recess between the first and second clamping portions, the adjustable cleat member is in an extended position and disposed between the toggle switch and the second end wall, and the bottom surface of the body engages the outer surface of the fixed base. At least one of the first and second clamping portions is adjusted to clamp the toggle switch between the first and second clamping portions. The adjustable cleat member is engageable with the second end wall of the switch assembly to prevent movement of the toggle switch to the second switching position.

BRIEF DESCRIPTION OF THE DRAWINGS

Features and advantages of the invention will become apparent from the following detailed description made with reference to the accompanying drawings, wherein.

DETAILED DESCRIPTION OF THE INVENTION

The Detailed Description of the Invention merely describes preferred embodiments of the invention and is not intended to limit the scope of the disclosure in any way. Indeed, the invention as described by the specification is broader than and unlimited by the preferred embodiments, and the terms in the specification have their full ordinary meaning.

Figure 1:
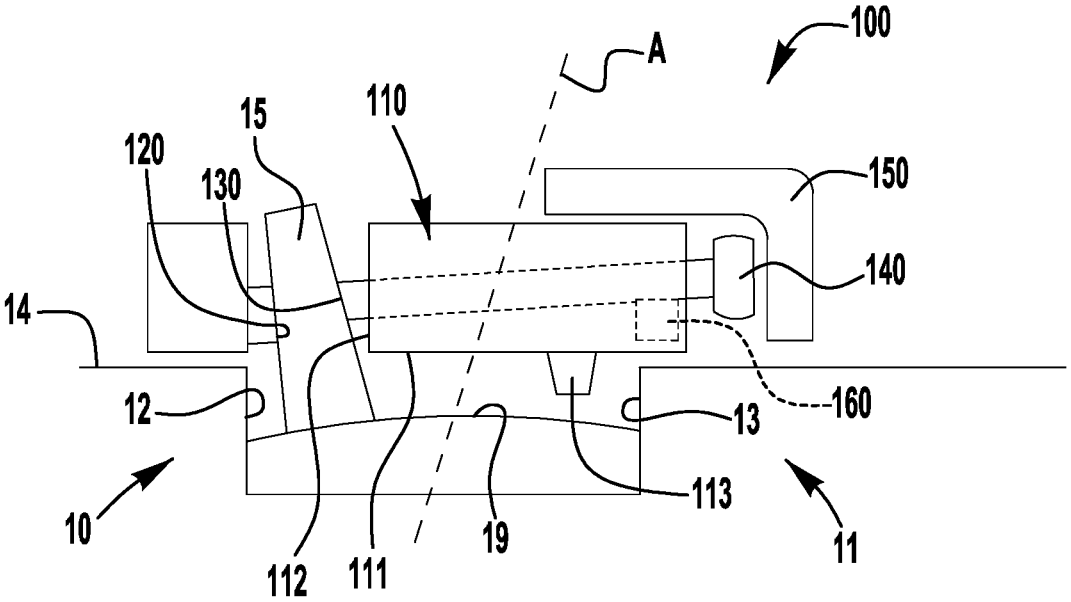
FIG. 1 is a side schematic cross-sectional view of a lockout device assembled with a switch assembly to prevent actuation of the switch assembly, according to an exemplary embodiment of the present disclosure, shown with the toggle switch in a first limit position.
Figure 2:
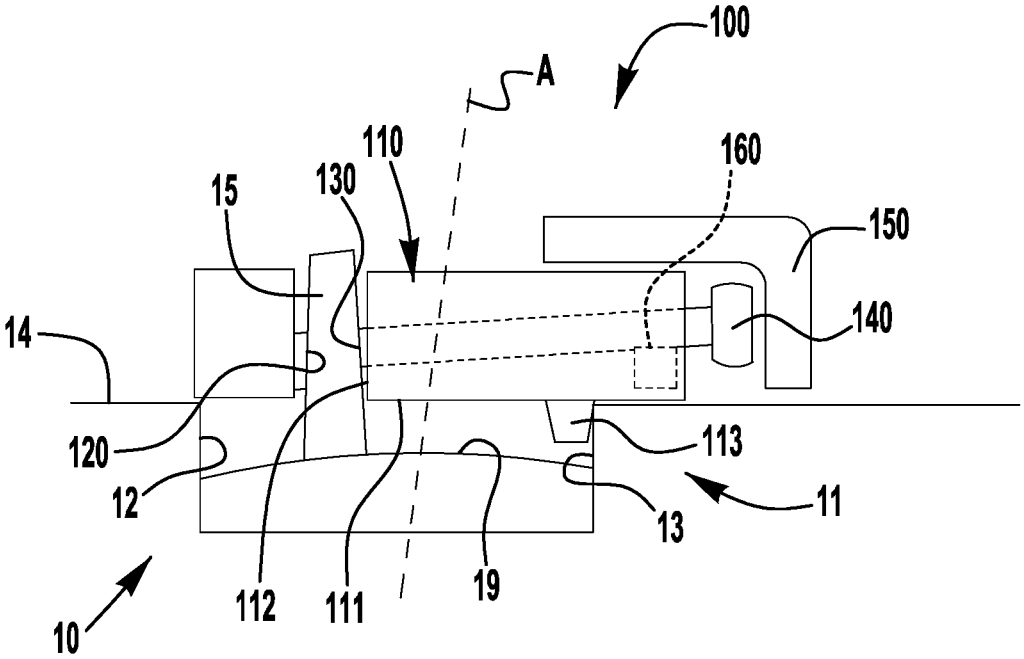
FIG. 2 is a side schematic cross-sectional view of the lockout device and switch assembly of FIG. 1, shown with the toggle switch in a second, non-actuated position, limited by a stop portion of the lockout device to prevent movement of the toggle switch to an actuating position.

The present disclosure contemplates lockout devices for securing a toggle switch of a switch assembly (e.g., a circuit breaker switch) in a desired position. As shown in FIG. 1, a conventional switch assembly 10 includes a fixed base 11 and a toggle switch 15 moveable between first (e.g., off) and second (e.g., on) limit positions between first and second end walls 12, 13 extending to an outer surface 14 of the fixed base. For a conventional circuit breaker switch, while the first and second limit positions are understood to be the "on" and "off" positions of the toggle switch, there is an intermediary actuating position (designated by axis A in FIG. 1) between the first and second limit positions at which the circuit load is reset, which may, but need not, coincide with an intermediary actuating position at which the circuit load is shut off. Therefore, in some embodiments, a switch lockout device does not necessarily secure the toggle switch in the limit position, but rather blocks movement of the toggle switch to the actuating position.

FIG. 1 schematically illustrates an exemplary lockout device 100 assembled with the switch assembly 10 to prevent movement of the toggle switch 15 to the actuating position A. The exemplary lockout device 100 includes a body 110 defining a bottom surface 111 and a recess 112 extending inward from the bottom surface to receive the toggle switch 15. A first clamping portion 120 is disposed on a first longitudinal side of the recess 112 and a second clamping portion 130 is disposed on a second longitudinal side of the recess opposite the first longitudinal side. An adjusting mechanism 140 is assembled with the body 110 and operable for longitudinal adjustment of the second clamping portion 130 to securely clamp the toggle switch 15 between the first and second clamping portions 120, 130, and to release the toggle switch to permit removal of the lockout device 100 from the switch assembly 10. A lockout arrangement 150 may be provided to prevent operation of the adjusting mechanism 140. For example, a lockout arrangement may secure the adjusting mechanism against movement, and/or may block access to the adjusting mechanism. In the illustrated example, the lockout arrangement 150 includes a cover member 151 that blocks access to the adjusting mechanism 140. The cover member may be secured in a lockout position by a padlock or other locking component, as described in greater detail below.

To prevent movement of the toggle switch 15 to the actuating position A, the bottom surface 111 of the body 110 includes a stop portion or fixed cleat, shown in the exemplary embodiment as a protrusion 113, that extends past the outer surface 14 of the switch base 11 to engage the end wall 13 of the switch assembly 10, thereby blocking further movement of the toggle switch 15. While the protrusion 113 may engage the end wall 13 when the toggle switch is in the limit position, in some embodiments (i.e., in some switch/lockout device combinations), the toggle switch 15 with the assembled lockout device 100 may have a limited range of movement between the limit position and engagement of the protrusion 113 with the end wall 13, while still preventing movement of the toggle switch to the actuating position A.

Figure 3A:
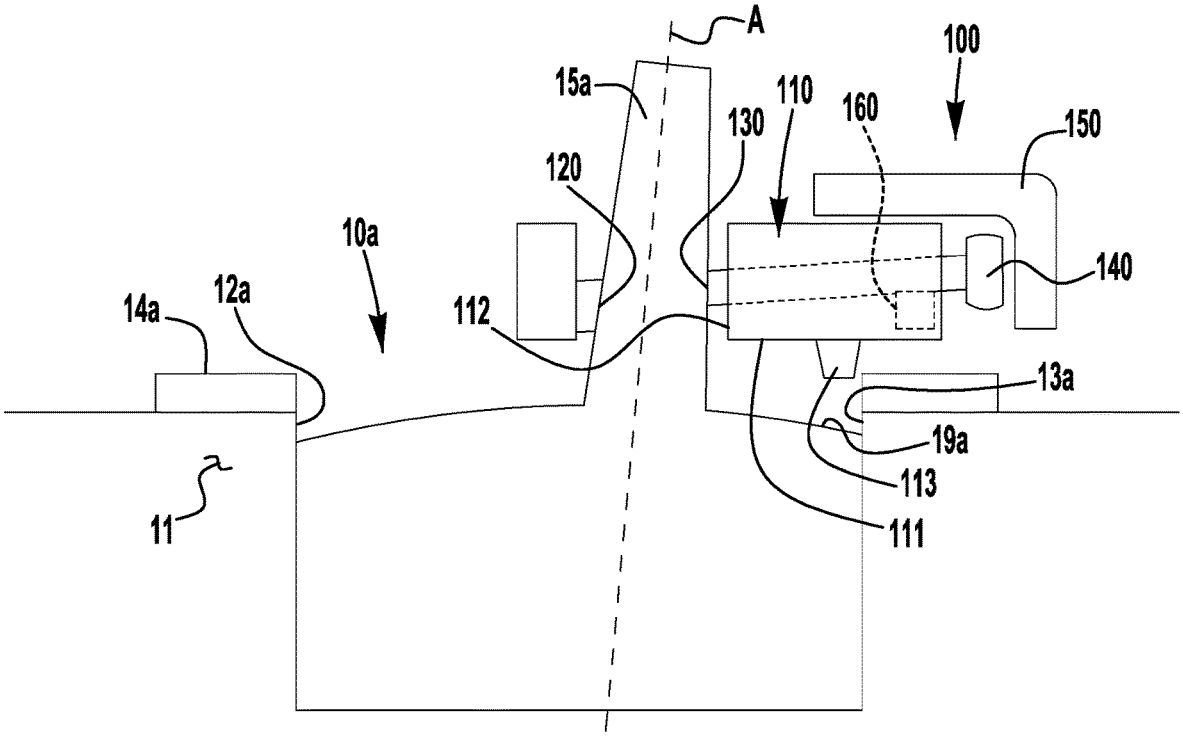
FIG. 3A is a side schematic cross-sectional view of the lockout device of FIG. 1 assembled with a switch assembly dimensionally different from the switch assembly of FIG. 1, such that the stop protrusion of the lockout device does not prevent movement of the toggle switch to an actuating position.

Switch assemblies have a variety of dimensions, including a variety of ranges between switch limit positions. As a result, a lockout device having a stop protrusion preventing actuation of a switch assembly with a more limited stroke toggle switch may be ineffective in preventing actuation of a switch assembly with a larger stroke toggle switch. FIG. 3 schematically illustrates the lockout device 100 of FIG. 1 assembled with a dimensionally different switch assembly 10*a*, having a toggle switch 15*a* with a greater range of motion between the first limit position and the second limit position. As a result, the protrusion 113 engages the second end wall 13*a* at a position beyond the actuating position A, rendering the lockout device 100 ineffective for securing the switch assembly 10*a* against actuation. In contrast, a lockout device having a stop protrusion positioned to prevent actuation of a switch assembly with a larger stroke toggle switch may not fit onto a switch assembly with a more limited stroke toggle switch.

Figure 3B:
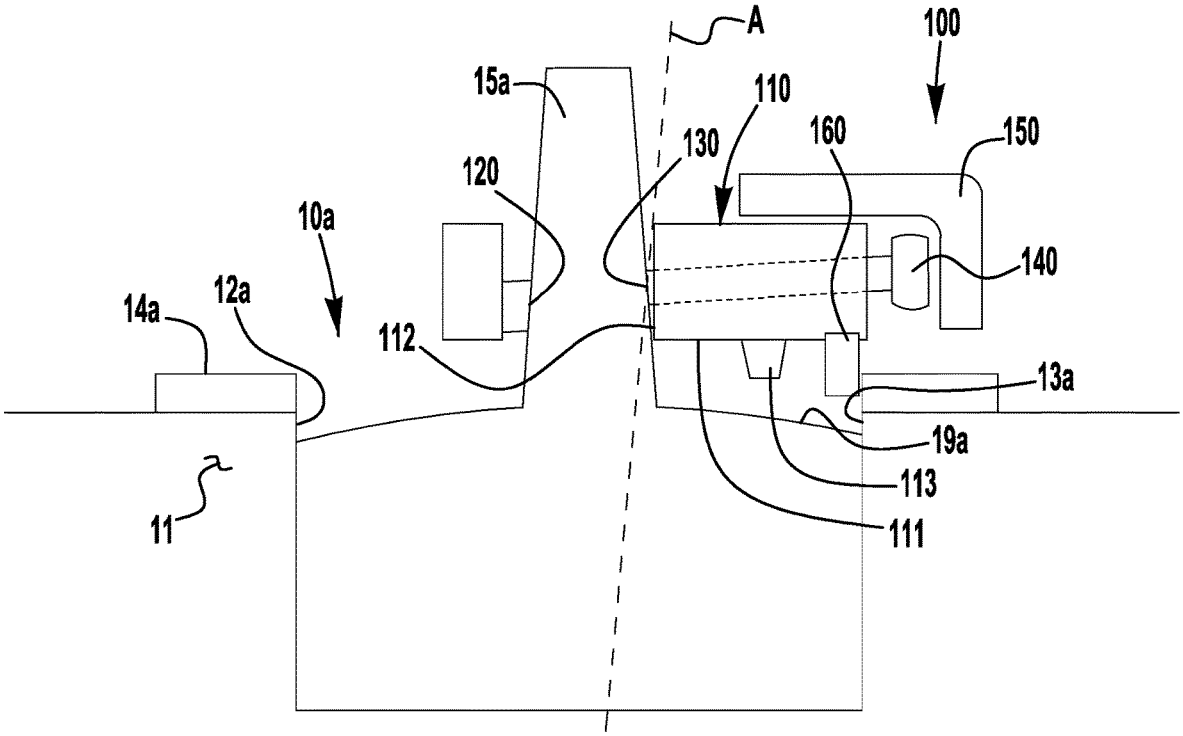
FIG. 3B is a side schematic cross-sectional view of the lockout device of FIG. 1 assembled with the switch assembly of FIG. 3A, with an adjustable cleat in an extended position to secure the switch assembly in a non-actuated position.
Figure 4:
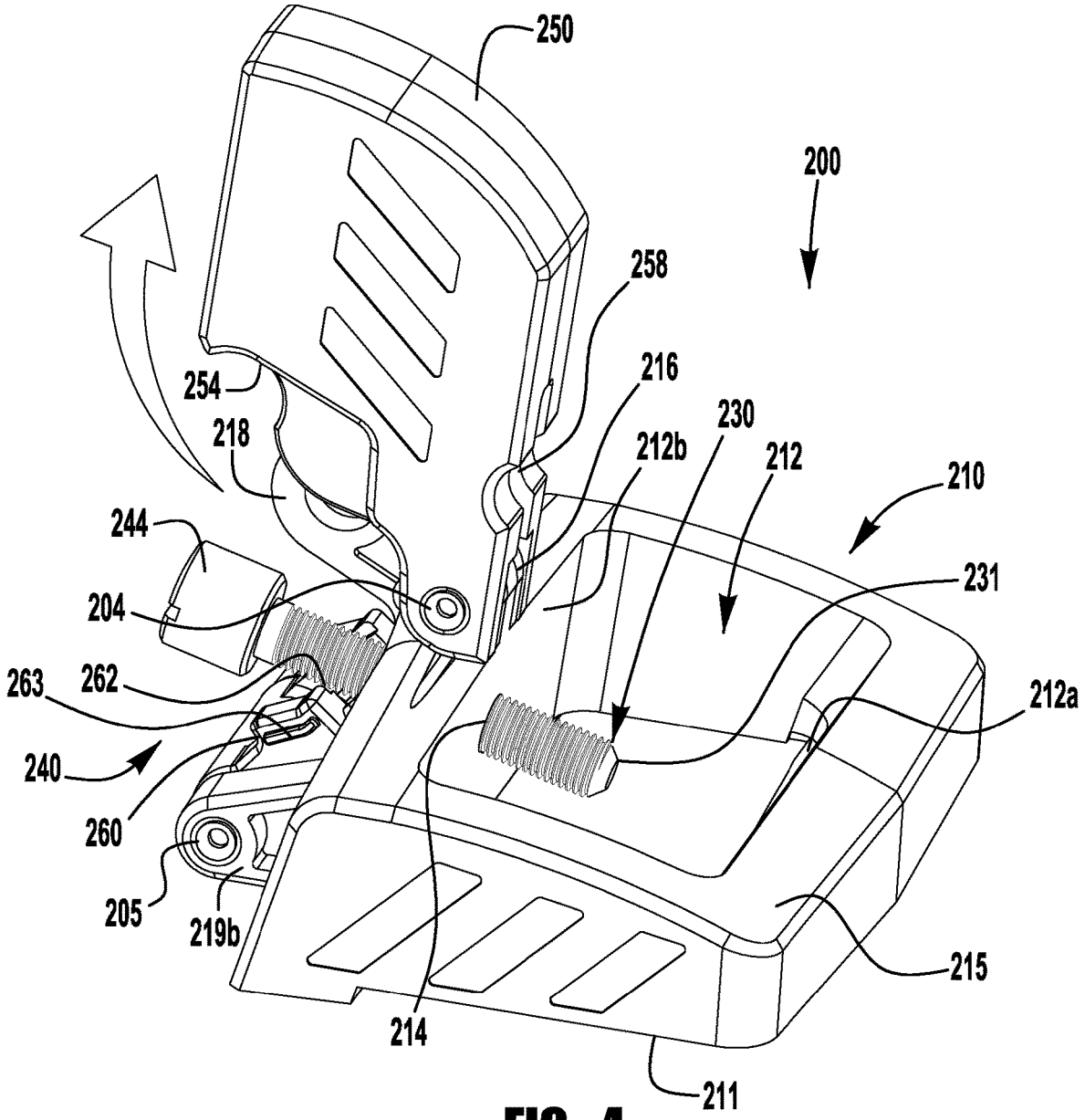
FIG. 4 is an upper perspective view of a switch lockout device, according to an exemplary embodiment of the present disclosure.
Figure 5:
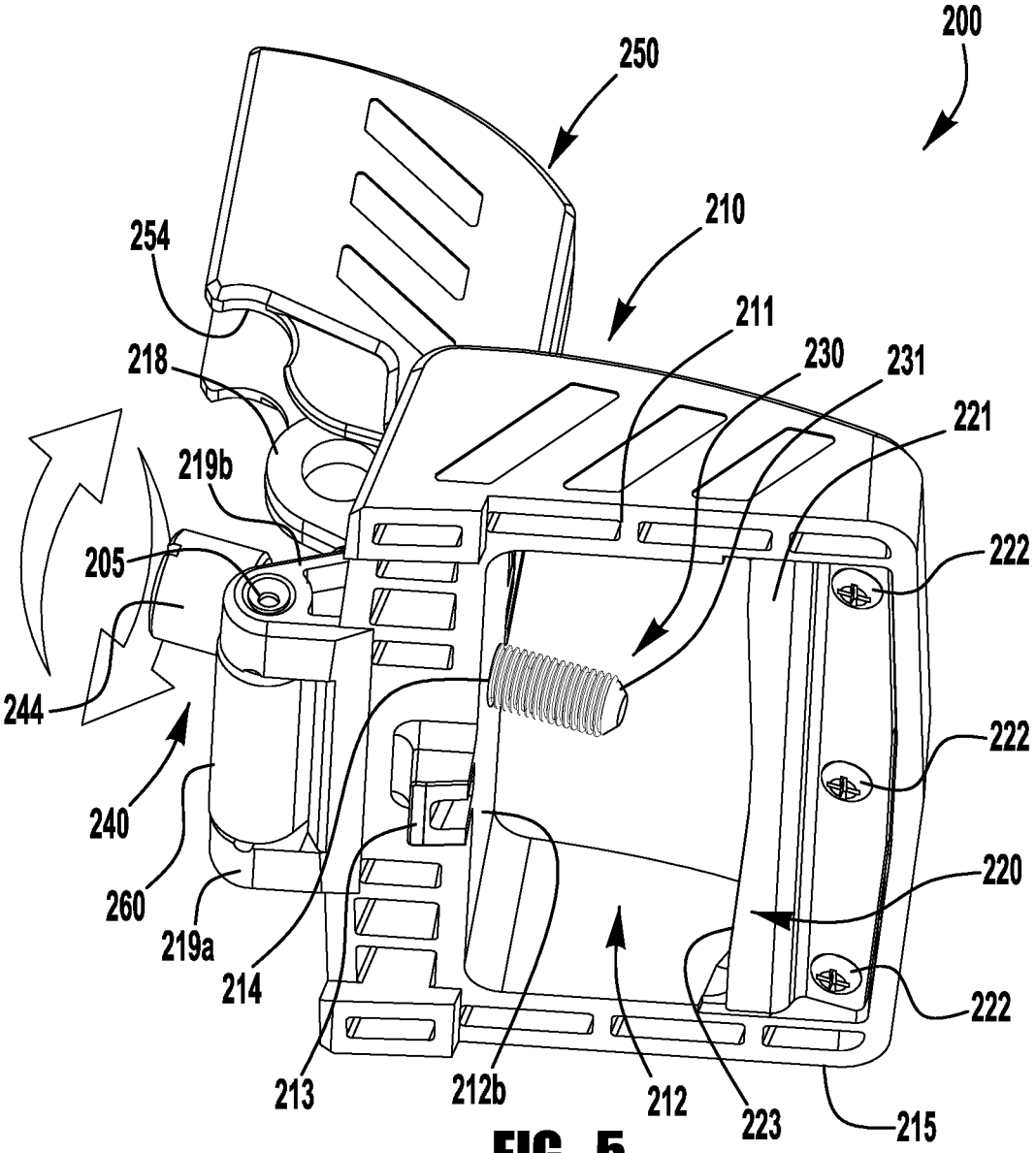
FIG. 5 is a lower perspective view of the switch lockout device of FIG. 4.

According to an aspect of the present disclosure, as schematically shown in FIGS. 1-3B, the switch lockout device 100 may be provided with an adjustable stop or cleat 160 that may be extended from the bottom surface 111 of the lockout device body 110 (as shown in FIG. 3B) to provide an alternative stop position for assembly with dimensionally different switch assemblies having different toggle switch strokes or ranges of motion. When the switch lockout device 100 is assembled with a first switch assembly 10 for which a protrusion 113 or other portion of the body engages the switch end wall 13 to prevent actuation, as shown in FIG. 1, the adjustable cleat 160 may be maintained in a retracted position, for example, to prevent interference with installation of the lockout device 100 on the switch assembly 10. When the switch lockout device 100 is assembled with a second switch assembly 10*a* for which the body protrusion 113 does not engage the switch end wall 13*a* to prevent actuation (as evident in FIG. 3A), the adjustable cleat 160 may be moved to an extended position, as shown in FIG. 3B, in which the cleat engages the switch end wall to prevent actuation. The cleat 160 may be adjustable on the lockout device body 110 using a variety of suitable arrangements, including, for example, a pivoting arrangement, a slidable arrangement, a ratcheting arrangement, or a threaded arrangement.

FIGS. 4-9 illustrate an exemplary lockout device 200 for securing to different switch assemblies (e.g., switch assemblies 10, 10*a* as shown in FIGS. 6-9) to prevent movement of a toggle switch to an actuating position. The exemplary lockout device 200 includes a body 210 defining a bottom surface 211 and a recess 212 extending inward from the bottom surface to receive the toggle switch. While many different types of toggle switch receiving recesses may be utilized, in the illustrated embodiment, the body 210 includes a perimeter wall 215 surrounding a central opening recess 212 sized to accommodate toggle switches having a range of widths, lengths, and thicknesses.

In the illustrated embodiment, first and second clamping portions 220, 230 are disposed on opposite first and second longitudinal sides 212*a*, 212*b* of the recess 212. The first clamping portion 220 includes a plate 221 that is secured to the bottom surface 211 of the body 210 (e.g., by fasteners 222), with a forward edge 223 positioned to grip a first side of a toggle switch. As shown, the forward edge 223 may be V-shaped to facilitate gripping or biting engagement of the toggle switch. In other embodiments, the forward edge may additionally or alternatively be serrated or toothed (not shown) to facilitate gripping or biting engagement with the toggle switch. The plate 221 may be removable and/or adjustable on the body (e.g., by adjusting the fastener in a slot in the plate), for example, to improve gripping engagement with a particular toggle switch. In other embodiments, other types of clamping members may be used, including, for example, knurled pads, or integral surfaces of the body. The second clamping portion 230 is defined by an end surface 231 of an actuating bolt 240 installed through a threaded bore 214 intersecting the second longitudinal side 212*b* of the recess 212. The bolt 240 is threadably adjustable (e.g., by turning the head 244 of the bolt using a tool or by hand) in the bore 214 for longitudinal adjustment of the clamping portion 230. The bolt head 244 may be knurled (not shown) to facilitate user grasping and turning of the bolt 240. In other embodiments, other types of clamping members and/or actuating mechanisms may be used, including, for example, knurled pads, plungers, or ratcheting bolts. In one such example, an adjustable bolt may be configured to drive a separate clamping member, such as a knurled pad.

In the exemplary embodiment, a lockout cover 250 is hingedly connected with an upper flange portion 216 of the body 210 (e.g., by staked pivot pin 204) and is pivotable between a closed or lockout position (FIGS. 6-9) blocking access to the bolt head 244 to prevent adjustment of the bolt 240 and an open position (FIGS. 4 and 5) permitting adjustment of the bolt 240 for removal of the lockout device 200 from the toggle switch 15. As shown, the body 210 includes an apertured tab or hasp 218 that is received through a slot 258 in the lockout cover 250 when the lockout cover is in the closed position, such that insertion of a padlock shackle (not shown) or other obstruction through the apertured tab 218 prevents movement of the lockout cover to the open position. Other lockout arrangements may additionally or alternatively be utilized. For example (not shown), a lockout device may include a lockout aperture positioned proximate to the adjustable bolt head (or other adjusting arrangement), such that insertion of a padlock shackle through the lockout aperture directly blocks access to and/or adjustment of the adjusting arrangement. As another example, a locking feature (e.g., padlock, locking bolt) may be secured with the adjusting bolt (or other adjusting mechanism) to secure the adjusting mechanism against movement.

Figure 6:
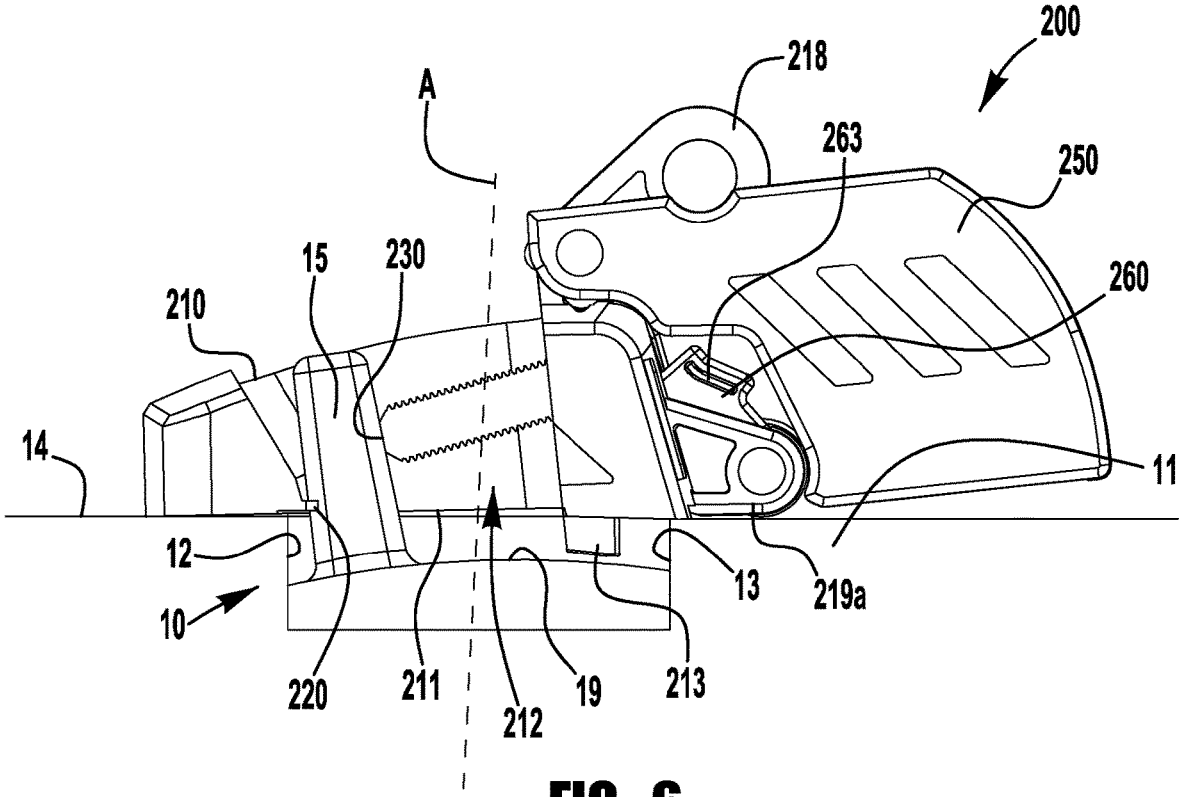
FIG. 6 is a side view of the lockout device of FIG. 4 assembled with a switch assembly to prevent actuation of the switch assembly, shown with the toggle switch in a first limit position, with a portion of the lockout device body removed to illustrate additional features of the lockout device.
Figure 7:
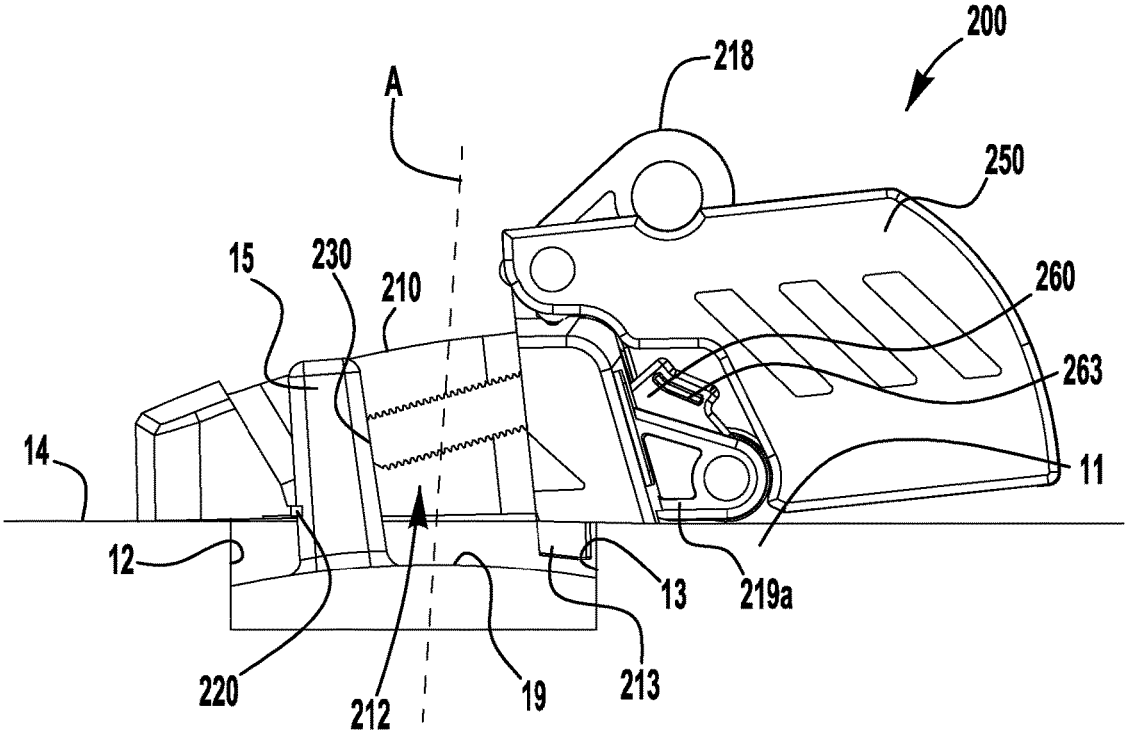
FIG. 7 is a side view of the lockout device of FIG. 4 assembled with the switch assembly of FIG. 6, shown with the toggle switch in a second, non-actuated position, limited by a stop portion of the lockout device to prevent movement of the toggle switch to an actuating position, with a portion of the lockout device body removed to illustrate additional features of the lockout device.
Figure 8:
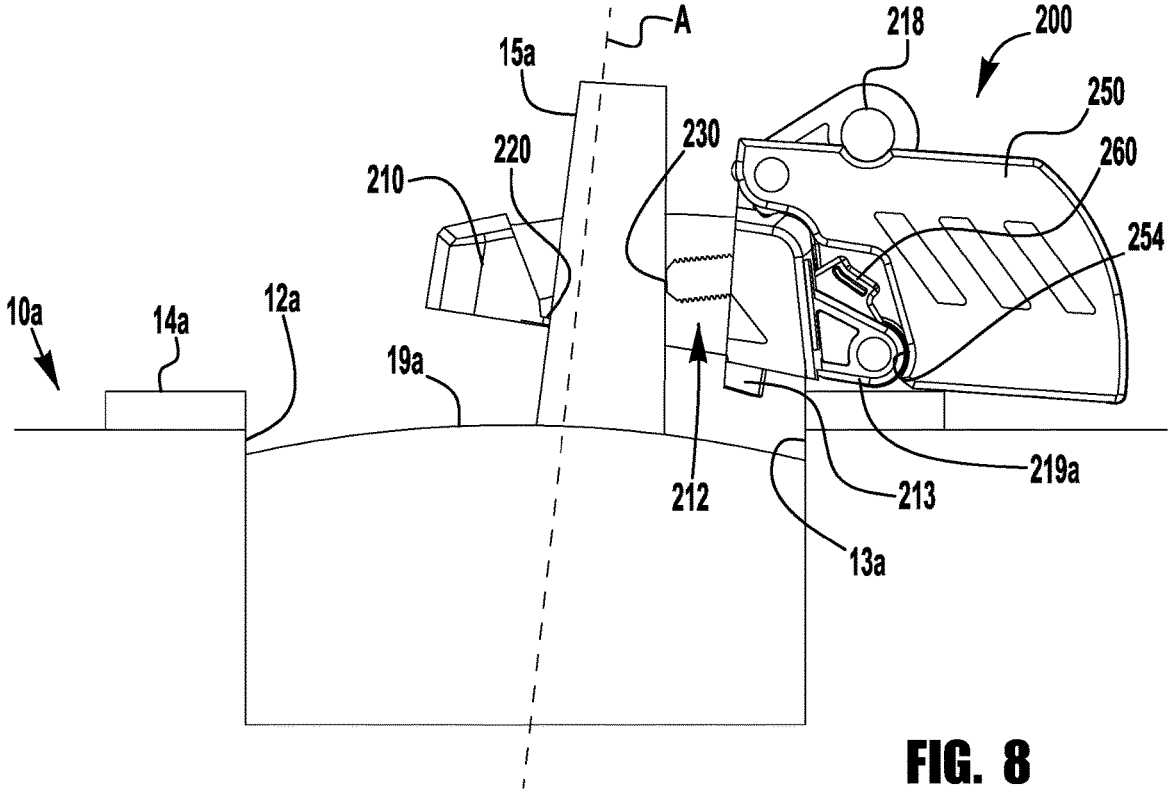
FIG. 8 is a side view of the lockout device of FIG. 4 assembled with a switch assembly dimensionally different from the switch assembly of FIG. 6, such that the stop protrusion of the lockout device does not prevent movement of the toggle switch to an actuating position, with a portion of the lockout device body removed to illustrate additional features of the lockout device.
Figure 9:
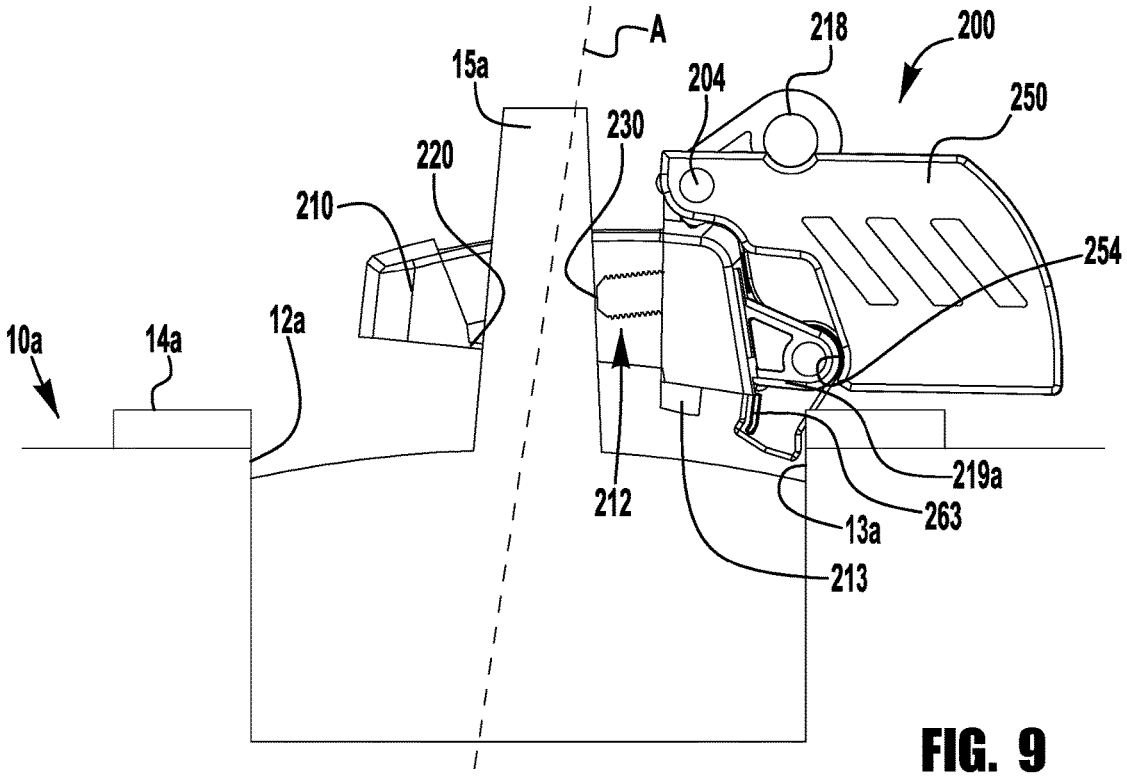
FIG. 9 is a side view of the lockout device of FIG. 4 assembled with the switch assembly of FIG. 8, with an adjustable cleat in an extended position to secure the switch assembly in a non-actuated position, with a portion of the lockout device body removed to illustrate additional features of the lockout device.

As shown in FIGS. 6 and 7, to prevent movement of the toggle switch 15 of a first switch assembly 10 to the actuating position A, the bottom surface 211 of the body 210 includes a stop portion or fixed cleat, shown in the exemplary embodiment as a protrusion 213, that extends past the outer surface 14 of the switch base 11 to provide a positive stop engagement with an end wall 13 of a switch assembly 10 to limit movement of the toggle switch. When the switch lockout device 200 is secured to the toggle switch 15 of the first switch assembly 10, the protrusion 213 engages the end wall 13 of the switch assembly 10 to block movement of the toggle switch 15 to the actuating position. As shown, the toggle switch 15 with the assembled lockout device 200 has a limited range of movement between the limit position and engagement of the protrusion 213 with the end wall 13, while still preventing movement of the toggle switch to the actuating position A. As shown, the protrusion 213 may be contoured to be wedged between the end wall 13 and a recessed extended surface 19 of the toggle switch 15.

To prevent movement of the toggle switch 15*a* of a dimensionally different (e.g., extended toggle switch stroke) second switch assembly 10*a* to the actuating position A, for which the protrusion 213 does not adequately limit toggle switch stroke (as evident in FIG. 8), the switch lockout device 200 includes an adjustable stop or cleat 260 that is movable from a retracted position (FIGS. 6-8) to an extended position (FIG. 9) to extend from the bottom surface 211 of the lockout device body 210 to provide an alternative stop position corresponding to the toggle switch stroke of the second switch assembly 10*a*. In the illustrated example, the adjustable cleat 260 is hingedly connected to rear flange portions 219*a*, 219*b* of the body 210 (e.g., by a staked pivot pin 205), for pivoting movement of the cleat 260 between the retracted and extended positions. The adjustable cleat 260 may include a rib 263 or other such feature to facilitate user grasping for pivoting movement of the cleat between retracted and extended positions. In the illustrated embodiment, the lockout cover 250 includes an edge portion 254 that engages the extended cleat 260 when the cover is in the closed position, thereby securing the cleat against retraction. This edge portion 254 may also secure the retracted cleat in the retracted position when the cover is closed. In other embodiments (not shown), other movable cleat arrangements may be employed, such as, for example, sliding, ratcheting, or threadably adjusted stop portions.

When the switch lockout device 200 is secured to the toggle switch 15*a* of the second switch assembly 10*a*, the extended cleat 260 engages the end wall 13*a* of the switch assembly 10*a* to block movement of the toggle switch 15*a* to the actuating position. As shown, the toggle switch 15*a* with the assembled lockout device 200 has a limited range of movement between the limit position and engagement of the protrusion 213 with the end wall 13*a*, while still preventing movement of the toggle switch to the actuating position A.

When the switch lockout device 200 is assembled with the first switch assembly 10, for which the protrusion 213 engages the switch end wall 13 to prevent actuation, as shown in FIG. 7, the adjustable cleat 260 may be maintained in a retracted position, for example, to prevent interference with installation of the lockout device 200 on the switch assembly 10.

In the illustrated embodiment, the adjustable cleat 260 includes first and second switch engaging portions 261*a*, 261*b* separated by a cutout portion 262 (FIG. 4) positioned to accommodate the bolt 240 when the adjustable cleat 260 is in the retracted position.

Figure 10:
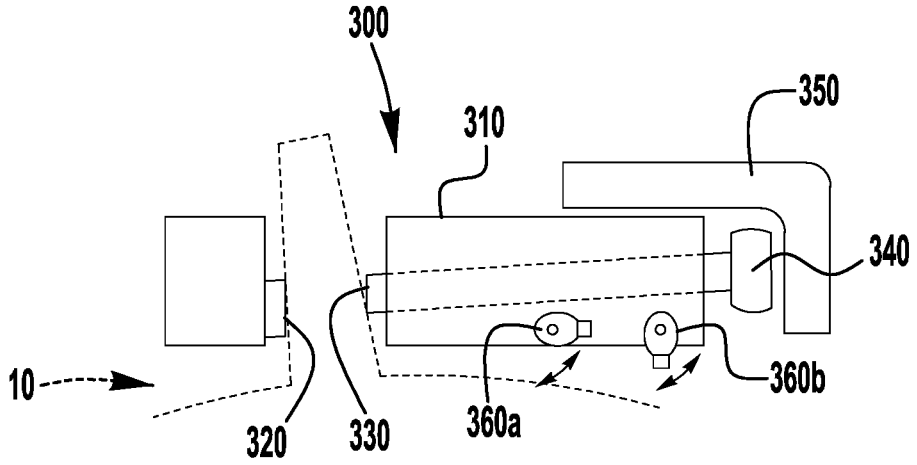
FIG. 10 is a side schematic view of another switch lockout device.
Figure 11:
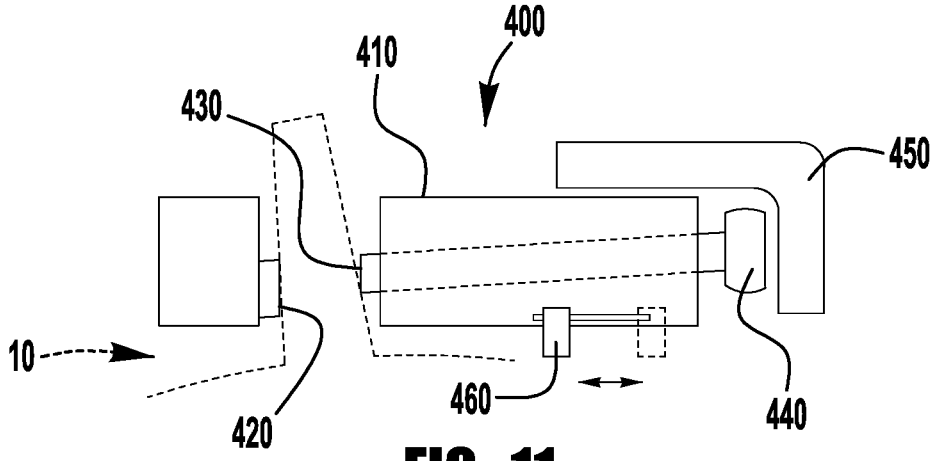
FIG. 11 is a side schematic view of another switch lockout device.

Still other switch lockout arrangements may be utilized in accordance with other aspects of the present disclosure. For example, as schematically shown in FIG. 10, a lockout device 300 may include multiple adjustable cleats 360*a*, 360*b* (e.g., similar to the pivotable adjustable cleat 260 of the embodiment of FIGS. 4-9), in addition to or in place of a fixed cleat or stop protrusion, positioned along the length of the body 310 to provide a stop feature at a selected one of a plurality of positions for installation with a variety of dimensionally different switch assemblies. As another example, as shown in FIG. 11, a lockout device 400 may include a longitudinally adjustable cleat 460, in addition to or in place of a fixed cleat or stop protrusion, positionable along the length of the body 410 to provide a stop feature at a selected one of a plurality of positions for installation with a variety of dimensionally different switch assemblies. Longitudinal adjustment of the cleat 460 may be provided using a variety of mechanisms, including, for example, one or more of a sliding mechanism, a ratcheting mechanism, and a threaded mechanism.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Parameters identified as "approximate" or "about" a specified value are intended to include both the specified value and values within 10% of the specified value, unless expressly stated otherwise. Further, it is to be understood that the drawings accompanying the present disclosure may, but need not, be to scale, and therefore may be understood as teaching various ratios and proportions evident in the drawings, either as explicitly shown, or as an approximation (i.e., +/−10%). Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

We claim:

1. A lockout device for a switch assembly, the lockout device comprising:

a body defining a bottom surface and a recess extending inward from the bottom surface to receive a toggle switch;

a first clamping portion disposed on a first longitudinal side of the recess;

a second clamping portion disposed on a second longitudinal side of the recess opposite the first longitudinal side, the second clamping portion being longitudinally adjustable for securely clamping the toggle switch between the first and second clamping portions; and an adjustable cleat member secured with the body separate from the first and second clamping portions and movable between a retracted position in which the cleat member is retained inward of the bottom surface of the body and an extended position in which the cleat member extends beyond the bottom surface of the body.

2. The lockout device of claim 1, wherein the recess comprises a central opening surrounded by an outer peripheral wall of the body.

3. The lockout device of claim 1, further comprising a bolt assembled with the body and threadably adjustable to longitudinally adjust the second clamping portion.

4. The lockout device of claim 3, wherein the second clamping portion is defined by an end surface of the bolt.

5. The lockout device of claim 1, further comprising a plate assembled with the body, wherein the first clamping portion is defined by an inward edge of the plate.

6. The lockout device of claim 5, wherein the inward edge of the plate is V-shaped.

7. The lockout device of claim 5, wherein the plate is adjustable to longitudinally adjust the inward edge of the plate.

8. The lockout device of claim 7, wherein the plate is adjustably secured to the body by a fastener.

9. The lockout device of claim 1, further comprising a lockout member assembled with the body and movable between a first position blocking adjustment of the second clamping portion, and a second position permitting adjustment of the second clamping portion.

10. The lockout device of claim 9, further comprising a bolt assembled with the body and threadably adjustable to longitudinally adjust the second clamping portion, wherein the lockout member comprises a cover that blocks access to the bolt when the lockout member is in the first position.

11. The lockout device of claim 9, further comprising a lockout aperture positioned to receive a padlock shackle to block movement of the lockout member from the first position to the second position.

12. The lockout device of claim 10, wherein the lockout aperture is defined by a tab extending from an upper portion of the body, and the cover includes a slot receiving the tab therethrough when the cover is in the first position.

13. The lockout device of claim 9, wherein when the cover is in the first position, a portion of the cover engages the adjustable cleat to secure the adjustable cleat in the extended position.

14. The lockout device of claim 1, wherein the adjustable cleat member is pivotably attached to the body for pivoting movement between the extended position and the retracted position.

15. The lockout device of claim 14, further comprising a bolt assembled with the body and threadably adjustable to longitudinally adjust the second clamping portion, wherein the adjustable cleat comprises a cutout portion positioned to accommodate the bolt when the adjustable cleat is in the retracted position.

16. The lockout device of claim 1, further comprising a second cleat extending beyond the bottom surface of the body.

17. The lockout device of claim 16, wherein the second cleat is fixed in an orientation extending beyond the bottom surface of the body.

18. In combination, a lockout device and a switch assembly, the switch assembly including a fixed base and a toggle switch moveable between first and second switching positions and disposed between first and second end walls extending to an outer surface of the fixed base, the lockout device comprising:

a body defining a bottom surface engaging the outer surface of the fixed base of the switch assembly and a recess receiving the toggle switch;

a first clamping portion disposed in the recess and in engagement with a first side of the toggle switch;

a second clamping portion disposed in the recess and in engagement with a second side of the toggle switch opposite the first side, the second clamping portion being adjustable between a clamping position for securely clamping the toggle switch between the first and second clamping portions and a releasing position permitting withdrawal of the toggle switch from the recess; and a cleat member secured with the body and movable between a retracted position in which the cleat member is retained inward of the bottom surface of the body and an extended position in which the cleat member extends beyond the bottom surface of the body such that the cleat member is engageable with the second end wall of the switch assembly to prevent movement of the toggle switch to the second switching position.

19. The combination of claim 18, wherein the lockout device further comprises a lockout member assembled with the body and movable between a first position blocking adjustment of the second clamping portion, and a second position permitting adjustment of the second clamping portion.

20. A method of securing a switch assembly including a fixed base and a toggle switch moveable between first and second switching positions and disposed between first and second end walls extending to an outer surface of the fixed base, the method comprising:

placing the toggle switch in the first switching position;

providing a lockout device including a body defining a bottom surface and a recess extending inward from the bottom surface, first and second clamping portions disposed on first and second longitudinal sides of the recess, and an adjustable cleat member secured with the body;

assembling the lockout device with the switch assembly such that the toggle switch is received in the recess between the first and second clamping portions, the adjustable cleat member is in an extended position and disposed between the toggle switch and the second end wall, and the bottom surface of the body engages the outer surface of the fixed base; and adjusting at least one of the first and second clamping portions to clamp the toggle switch between the first and second clamping portions;

wherein the adjustable cleat member is engageable with the second end wall of the switch assembly to prevent movement of the toggle switch to the second switching position.

* * * * *